US010352661B2

(12) United States Patent
Pfister

(10) Patent No.: US 10,352,661 B2
(45) Date of Patent: Jul. 16, 2019

(54) SURVIVABILITY CAPSULE FOR ARMORED VEHICLES

(71) Applicant: 2040422 ONTARIO INC., Dorchester (CA)

(72) Inventor: Karl Gerhard Pfister, Thorndale (CA)

(73) Assignee: 2040422 ONTARIO INC., Dorchester, Ontario (CA)

( * ) Notice: Subject to any disclaimer, the term of this patent is extended or adjusted under 35 U.S.C. 154(b) by 0 days.

(21) Appl. No.: 15/030,976

(22) PCT Filed: Oct. 23, 2014

(86) PCT No.: PCT/CA2014/000772

§ 371 (c)(1),
(2) Date: Apr. 21, 2016

(87) PCT Pub. No.: WO2015/058290

PCT Pub. Date: Apr. 30, 2015

(65) Prior Publication Data

US 2016/0245622 A1 Aug. 25, 2016

Related U.S. Application Data

(60) Provisional application No. 61/894,725, filed on Oct. 23, 2013.

(51) Int. Cl.
*F41H 7/00* (2006.01)
*F41H 7/04* (2006.01)

(52) U.S. Cl.
CPC ..... *F41H 7/044* (2013.01); *F41H 7/048* (2013.01)

(58) Field of Classification Search
CPC ..... F41H 7/048
See application file for complete search history.

(56) References Cited

U.S. PATENT DOCUMENTS

| | | | | |
|---|---|---|---|---|
| 4,492,282 | A | 1/1985 | Appelblatt et al. | |
| 5,474,352 | A * | 12/1995 | Davies | F41H 7/044 296/187.07 |
| 8,096,225 | B1 | 1/2012 | Johnson et al. | |
| 8,667,880 | B1 | 3/2014 | Berman | |
| 8,752,470 | B2 | 6/2014 | Kocher et al. | |
| 8,931,391 | B2 * | 1/2015 | Kocher | F41H 7/042 89/36.08 |
| 2007/0094943 | A1 * | 5/2007 | Deisenroth | B60N 2/4242 52/79.1 |

(Continued)

FOREIGN PATENT DOCUMENTS

| | | | | |
|---|---|---|---|---|
| DE | 3206794 A1 * | 9/1983 | | B62D 11/10 |
| DE | 2066169 A1 * | 4/1985 | | F41A 9/26 |

OTHER PUBLICATIONS

Definition of "Complementary". English Oxford Living Dictionaries. 2017 Oxford University Press.*

*Primary Examiner* — Gabriel J. Klein

(57) ABSTRACT

A survivability capsule for the driver compartment of an armored vehicle resists explosive loads and improves the survivability of the driver. The survivability capsule has a seamless unibody structure made from molded composite armor and is installed within the driver compartment of an armored vehicle. The unibody is shaped complementary to the interior shape of the driver compartment for a contour fit therein and is rigidly attached to the frame of the vehicle.

8 Claims, 6 Drawing Sheets

(56) References Cited

U.S. PATENT DOCUMENTS

| | | | | |
|---|---|---|---|---|
| 2010/0102596 | A1* | 4/2010 | Chapman | A61G 3/00<br>296/193.03 |
| 2011/0088544 | A1 | 4/2011 | Bettencourt et al. | |
| 2011/0272968 | A1* | 11/2011 | Medwell | F41H 7/04<br>296/193.03 |
| 2012/0181100 | A1* | 7/2012 | Halliday | B60K 5/00<br>180/291 |

* cited by examiner

1

SURVIVABILITY CAPSULE FOR ARMORED VEHICLES

FIELD OF THE INVENTION

This invention relates to a survivability capsule for the driver compartment of an armored ground vehicle.

BACKGROUND

Light armored vehicles (LAVs) have been in military use around the world in combat and combat support roles for many years. Common LAV variants combine interior space for personnel transport with a driver compartment, engine compartment, and armaments for combat. These types of LAVs share a weak structural point at the driver compartment.

LAVs are designed with the engine and driver compartments adjacent to one another at the front of the vehicle. As a result of this design, space in the driver compartment is limited and does not permit an ordinarily acceptable or desirable level of structural reinforcement and armoring of the driver compartment. Existing LAVs use separate structural components to selectively reinforce areas of the driver compartment, resulting in a lack of overall strength in the area. This places the driver at an increased risk of injury or death in the event the driver compartment is exposed to an explosive blast, such as the blast delivered by a mine or improvised explosive device (IED).

In the event, for example, a LAV is exposed to an explosive blast to the underside of the vehicle, beneath the driver compartment, the resulting explosive load acts to deform the driver compartment, which may collapse inwardly on the driver. This occurs because of a reduced level or armoring or insufficient structural reinforcement in the driver compartment primarily due to insufficient space therefor.

The technical challenge for improvement of the safety and survivability of the driver is to find space in which to fit sufficient armor and structural components to effectively reinforce the driver compartment to resist the explosive load delivered by mines or IEDs and thereby protect the driver.

As a result, there exists a need to improve the survivability of a LAV driver from an explosive blast. Practically and economically, there is a need to retrofit existing LAVs, rather than replace them with new designs, due to the lengthy procurement process which takes years to bring new vehicles into service.

SUMMARY OF THE INVENTION

The present invention is survivability capsule for the driver of an armored vehicle, which has a frame and a driver compartment interior of the frame that is defined by an open space within the frame and has an interior shape. The survivability capsule includes a unibody made of molded composite armor with an exterior shape complementary to the interior shape of the driver compartment so as to fit therein. The unibody has attachment locations for rigidly attaching the unibody to frame elements of the vehicle.

In another embodiment, the survivability capsule has an ingress/egress opening accessible from the interior of the vehicle.

In yet another embodiment, the rigid attachment of the unibody to the frame includes one or more spacers therebetween.

In yet another embodiment, the driver compartment is offset to one side of the armored vehicle and the unibody is rigidly attached to the frame on one side by a wall structure consisting of molded composite armor rigidly attached at each end to the unibody and the frame.

Further features of the invention will be described or will become apparent in the course of the following description.

BRIEF DESCRIPTION OF THE DRAWINGS

In order that the invention may be more clearly understood, a preferred embodiment thereof will now be described in detail by way of example, with reference to the accompanying drawings, in which.

DETAILED DESCRIPTION OF THE INVENTION

Figure 1A:
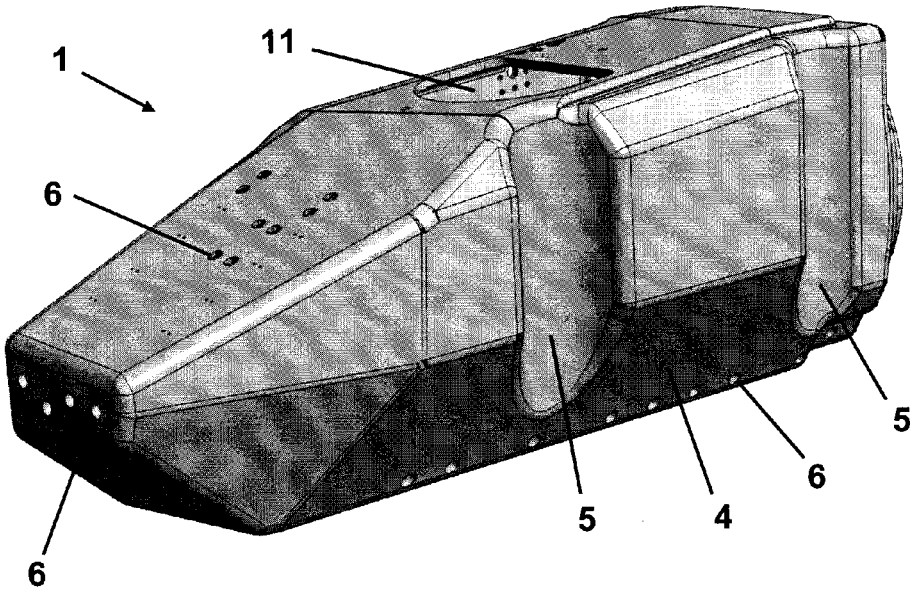
FIG. 1A is a shaded perspective view of the survivability capsule.

As a means of protecting the driver of an armored vehicle, such as a LAV, from blast loads from anti-tank mines or improvised explosive devices (IEDs), an armored vehicle can be equipped with a specially configured survivability capsule, according to the present invention. The molded composite capsule is intended to transfer blast compression loads, bending moments and torsional loads acting on the driver compartment to the frame of the vehicle.

The preferred embodiment according to the present invention is a survivability capsule installed within the driver compartment of an armored vehicle and rigidly attached to the frame of the vehicle. The survivability capsule provides the strength, stiffness, and structural integrity required to better withstand and distribute explosive loads. The driver compartment is the location within the armored vehicle frame that houses the driver, the driver seat, and any mobility, optics, communications, weapons, or other controls which the driver is required to manipulate while operating the vehicle. In the event the driver compartment of the vehicle is exposed to an explosive blast, the survivability capsule prevents or minimizes catastrophic structural collapse, which would ordinarily occur. The survivability capsule may be incorporated into the manufacture of a new vehicle or installed in an existing vehicle by way of a retrofit.

As shown in FIGS. 1-8, the survivability capsule according to the present invention comprises a seamless structure, or unibody 1, of molded composite armor installed in the driver compartment 2 and rigidly attached to the frame 3 of an armored vehicle. The shape of the unibody 1 is generally complementary to the shape of the interior of the driver compartment 2. Benefits of using a composite armor unibody 1 include resisting or minimizing local deformation of the driver compartment. This is accomplished by distributing blast loads from the underside of, or adjacent to, the driver compartment 2 to the much larger mass of the armored vehicle frame 3, enabling more of the vehicle mass to take up the blast loads, rather than just the driver compartment 2 area.

The unibody 1 is made in one seamless piece from fiber reinforced resin. Preferably, E-Glass, S-Glass, Aramid, and Carbon are used in individual layers or as a hybrid weave for the fiber reinforcement of an epoxy resin. Other materials may be used in the composite armor, so long as they provide similar structural characteristics to the unibody 1. The one piece, shell-like construction and composite materials provide significant strength and weight savings, over traditional reinforcement approaches.

The unibody 1 may be manufactured by any known method of producing seamless composite structures. Preferably, the unibody 1 is manufactured by low pressure transfer molding, whereby the unibody 1 is manufactured in a closed mold with a collapsible mandrel shaping the inside and a multi-component negative mold forming the outside contour of the unibody 1. The epoxy resin is drawn into the fiber reinforcement stack-up, which occupies the cavity between the mandrel and the outer mold, through the pressure difference between the vacuum ports on the one side and the resin reservoir on the other side.

Figure 1B:
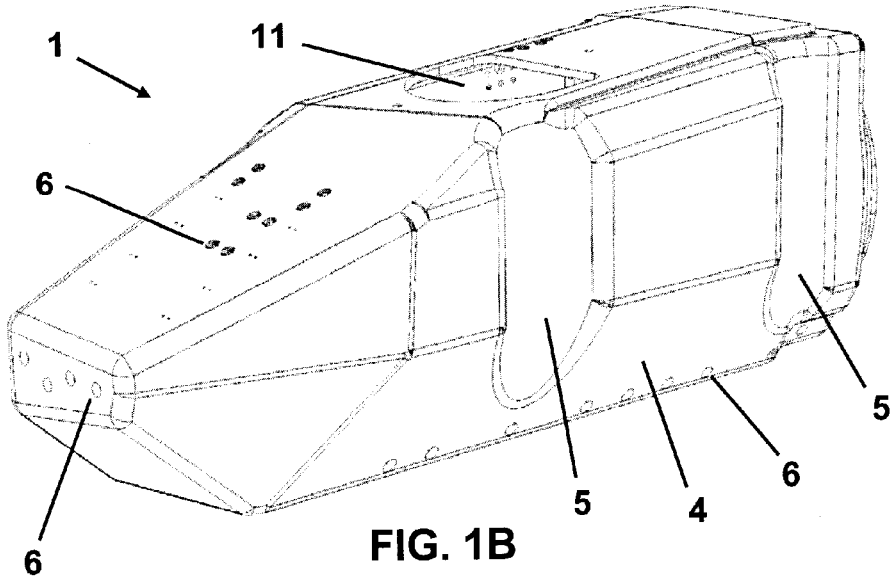
FIG. 1B is the same view as shown in FIG. 1A.
Figure 2A:
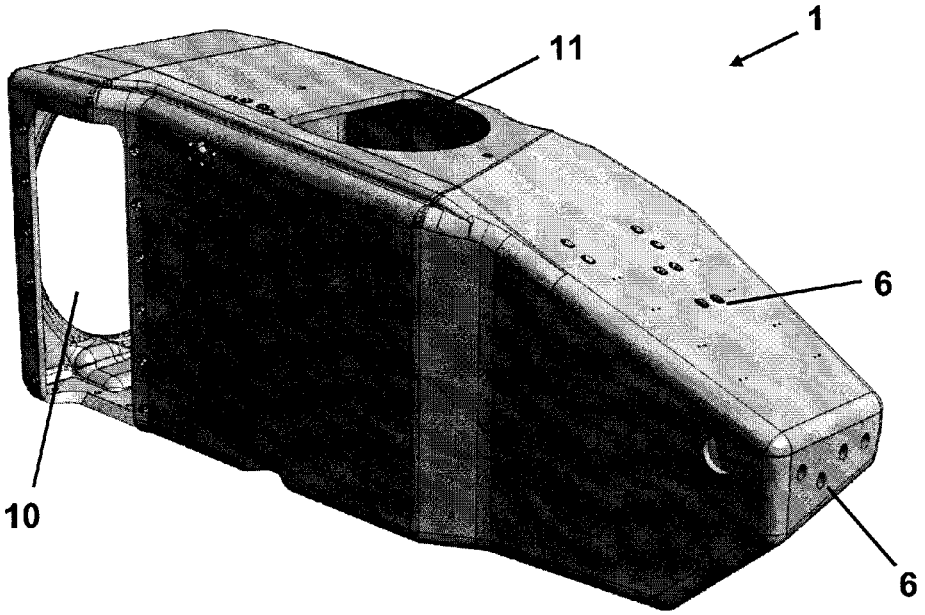
FIG. 2A is another shaded perspective view of the survivability capsule.
Figure 2B:
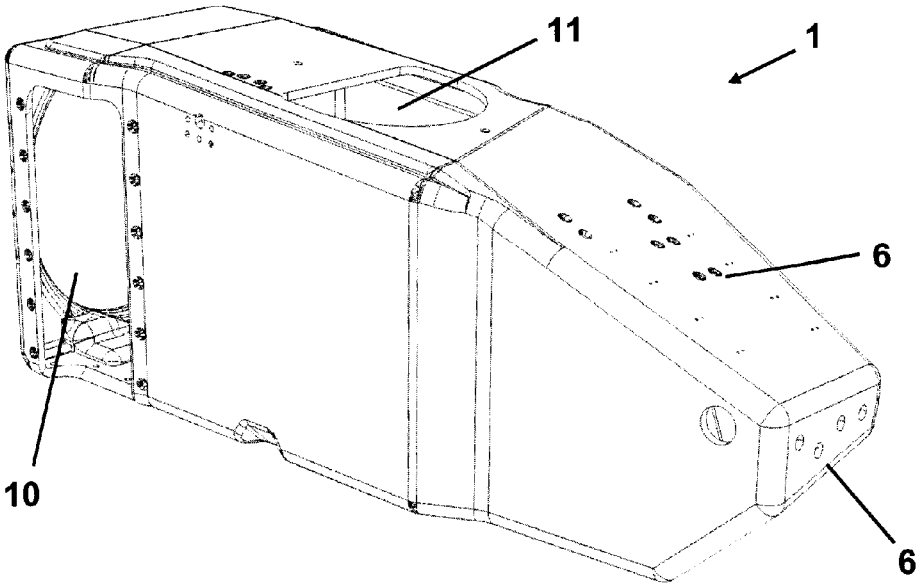
FIG. 2B is the same view as shown in FIG. 2A.
Figure 3:
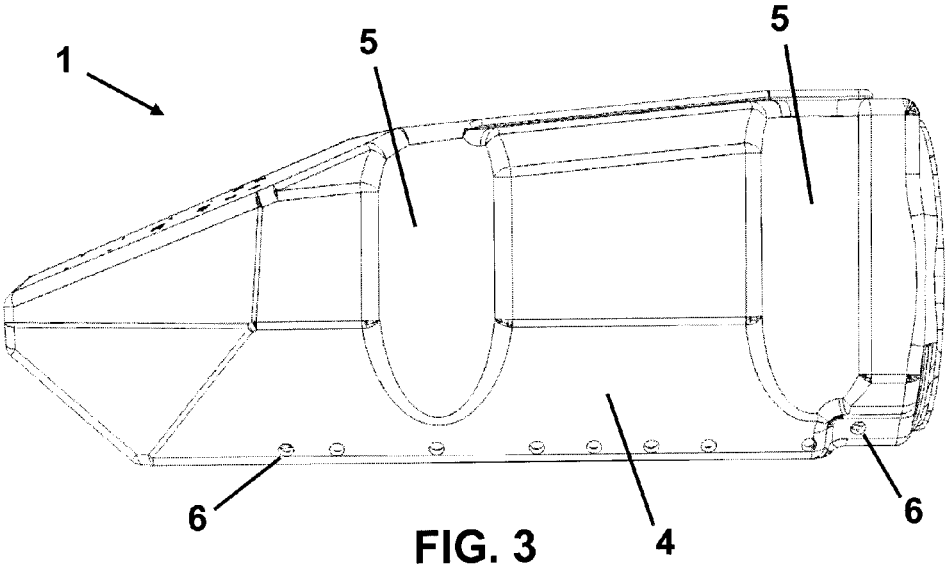
FIG. 3 is a side view of the survivability capsule.
Figure 4:
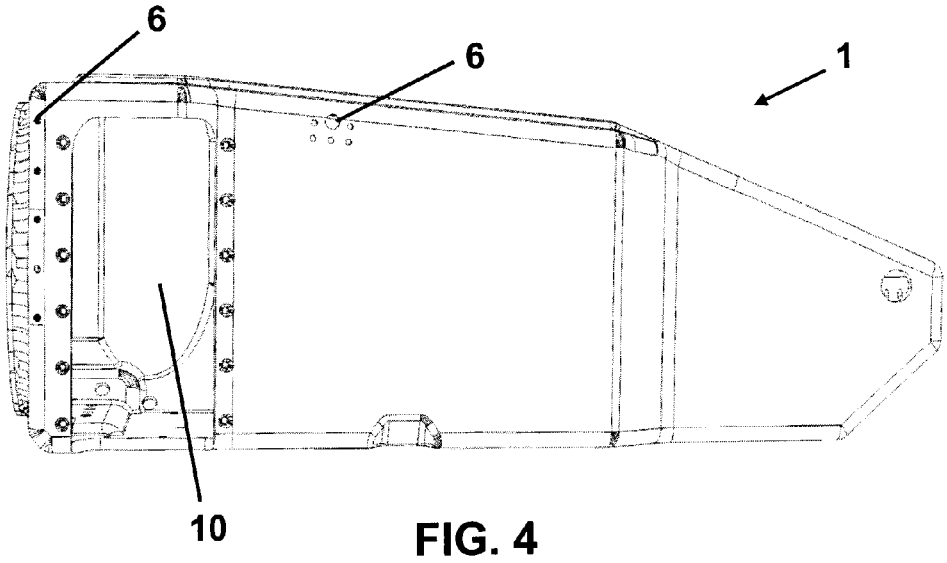
FIG. 4 is a side view of the survivability capsule opposite to FIG. 3.
Figure 6:
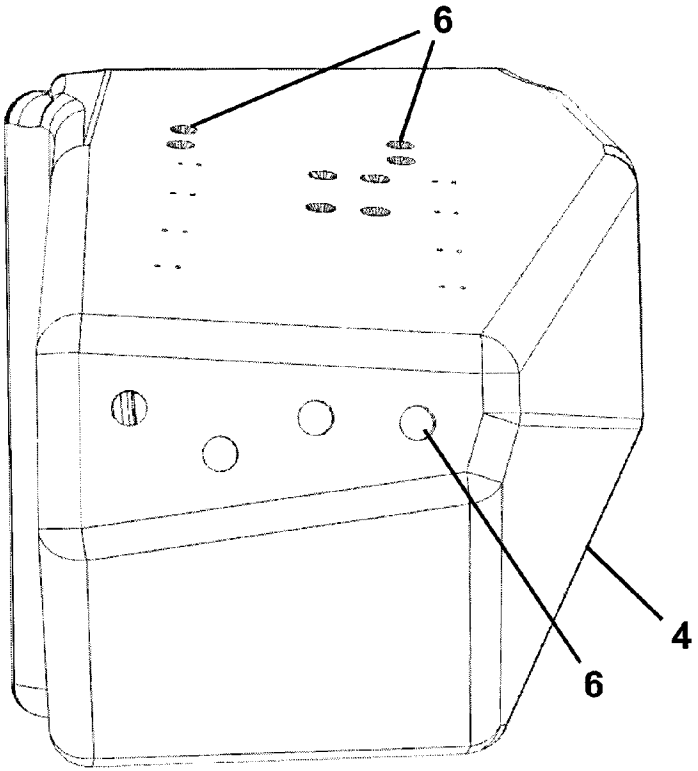
FIG. 6 is a front view of the survivability capsule.

The unibody 1 is rigidly attached to the frame 3 of the armored vehicle to thereby act to distribute the loads from an explosive blast acting on the driver compartment 2 to the remainder of the vehicle. Preferably, the unibody 1 is attached to multiple surfaces of the surrounding frame 3 and is shaped or contoured to fit closely in the driver compartment 2, against the frame 3 and floor elements of the armored vehicle. A "contour fit" is intended, meaning the shaping of the exterior of the unibody 1 so that it is complementary to the interior shape of the driver compartment 2 to fit closely therein, to thereby more effectively transfer blast loads to the surrounding frame 3. For example, the unibody 1 may be shaped to abut against the inside wall of the wheel well on the left side of the vehicle, as shown at 4 in FIGS. 1A, 1B, 6, and 8. As shown in FIGS. 1A, 1B, and 3, one side of the unibody 1 abuts to the two suspension strut towers, at 5, and the roof line. As shown in FIGS. 2A, 2B, and 4, the unibody 1 abuts the general shape of the wall separating the driver compartment 2 from the engine and transmission and spans between the drive shaft center tunnel and the roof line.

The unibody 1 is rigidly attached to the frame 3 of the armored vehicle at attachment locations on the unibody 1. Preferably, the unibody 1 is rigidly attached to the frame 3 by means of welded bushings and bolt fasteners (not shown) passing through apertures 6 at various attachment locations on the unibody 1. However, any means of rigidly attaching the unibody 1 to the frame 3 that enables the distribution of blast loads from the driver compartment 2 to the frame 3 may be used. When so attached, the shell-like or tubular cross section of the unibody 1 effectively resists or minimizes deformation and transfers blast loads acting on the driver compartment 2 to the frame 3 of the armored vehicle.

The force of an explosion adjacent or under the driver compartment 2 is thus transferred and absorbed by the inertia of the entire vehicle, primarily resulting in lift and/or rotation of the vehicle, rather than by deformation of the vehicle structure surrounding the driver compartment 2. This assists to preserve the space within the driver compartment 2, improving the survivability of the driver in the event of an explosive blast.

Figure 5:
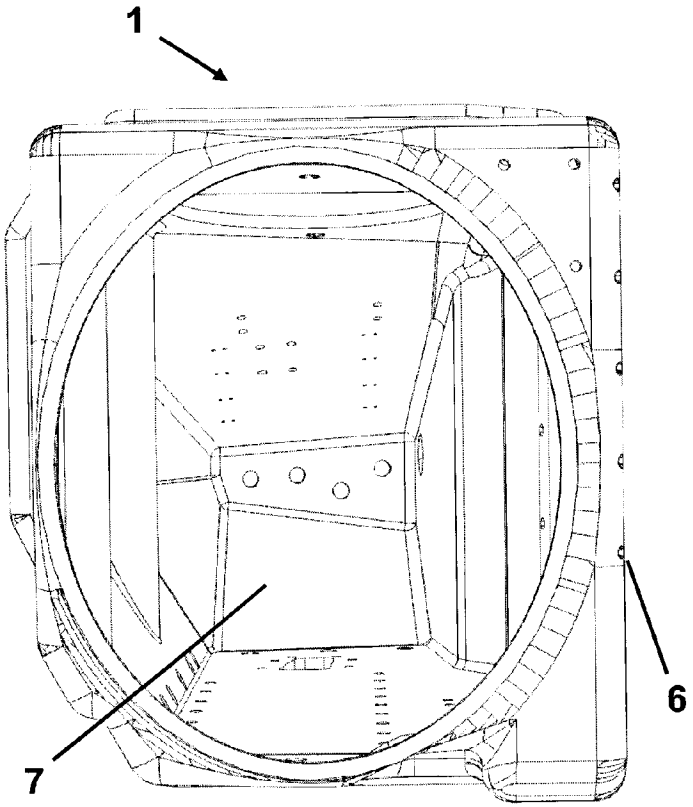
FIG. 5 is an end view of the survivability capsule.

The unibody 1 has an ingress/egress opening 7 accessible from the interior of the armored vehicle to permit the driver to move between the driver compartment 2 and other areas within the interior of the armored vehicle. As shown in FIG. 5, the geometry of the opening 7, preferably located at the rear of the unibody 1, provides for the largest possible opening, while maintaining the desired strength, stiffness, and structural integrity of the unibody 1. The shape of the opening 7 is preferably an egg-shaped elliptical opening.

Typically, in armored military ground vehicles, such as LAVs, the driver compartment 2 is offset to one side at the front of the vehicle, adjacent the engine compartment 8. In such a vehicle configuration, one side of the unibody 1 is spaced apart from the outside frame 3 of the vehicle on the other side of the engine compartment 8. Bracing may be used to connect the unibody 1 to the spaced apart side of the frame 3 to improve the transfer of blast loads to the entire frame 3 of the vehicle. Preferably, a wall structure 9 extending across the rear of the engine compartment 8 to the side of the frame 3 is used as bracing, consisting of molded composite armor rigidly attached at each end to the unibody 1 and the frame 3. In addition to distributing explosive loads, the composite armor wall structure 9 inherently functions as a traditional firewall or a spall liner.

Preferably, a second ingress/egress opening, such as an engine hatch 10, is provided in the rear side corner of the unibody 1, as shown in FIGS. 2A, 2B, and 4, to allow easy access to certain components in the engine compartment 8 from the driver compartment 2, such as the essential quick connects like fuel lines, hydraulic lines and electrical bus system as well as the drive shaft flange coupling the automatic gear box to the transfer case. This engine hatch 10 is preferably provided with a door or hatch closure (not shown), shaped to fit tightly with the unibody 1 and preserve the contour fit within the driver compartment 2. The door or hatch closure is mounted to the unibody 1 with sufficient fasteners to transfer loads from an explosive blast.

Figure 7:
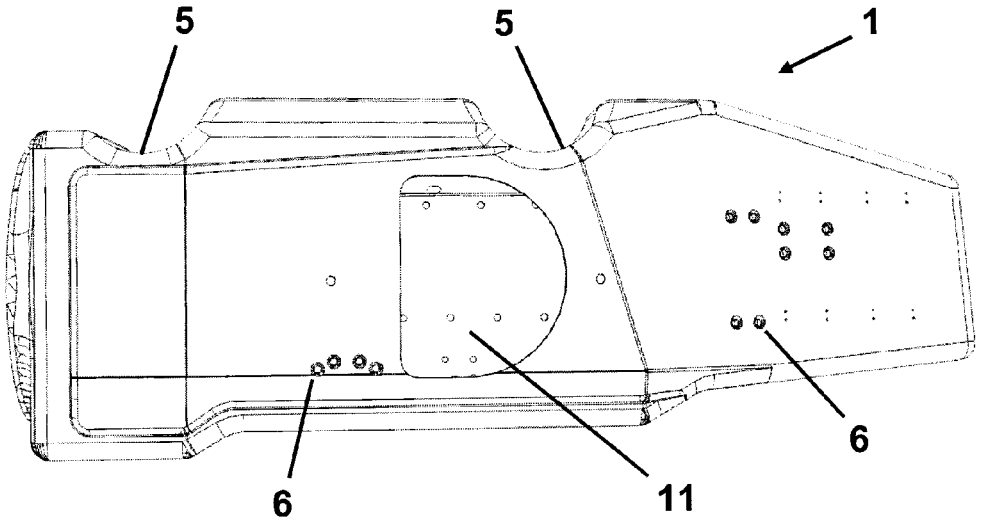
FIG. 7 is a top view of the survivability capsule.
Figure 8:
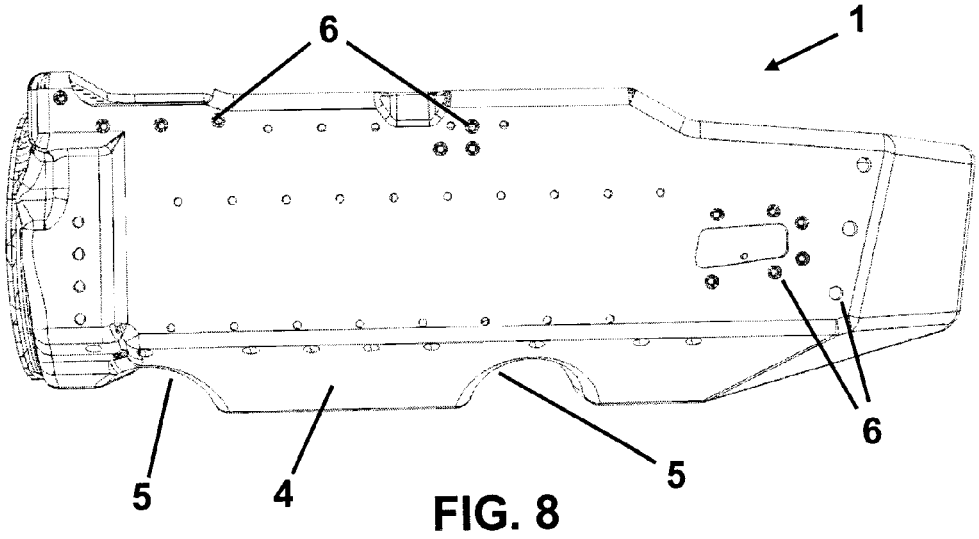
FIG. 8 is a bottom view of the survivability capsule.

A driver seat (not shown) is mounted in the interior of the unibody 1. Preferably, the driver seat is adjustable between at least two positions. First, an upright seated position with the driver's head protruding from a top hatch 11 provided on the unibody 1, as shown in FIG. 7, for improved viewing while driving. Second, an inclined position for driving with the top hatch 11 in a closed position. The driver may operate the vehicle in an upright seated position in a non-hostile environment and may operate the vehicle in the inclined position with the top hatch 11 closed while in a hostile environment.

The driver seat is also preferably equipped with a mine protected seating system with absorbing elements, such as a swing arm, to reduce the shock of an explosive impact on the body of the driver. The inclined seat position also assists with reducing the stress from the g-forces on the body of the driver during an explosive impact, because the body is more resistant to the g-forces experience during such an event when in a transverse position, compared to an upright position. Preferably, the mine protection seating system and vehicle controls, such as the steering column and foot pedals, are supported from the top of the unibody 1.

To provide added resistance to deformation and increased protection for the passengers or crew of the armored vehicle, a mine floor system, or armored floor (not shown), may be installed in the passenger compartment 12. The armored floor consists of one or more composite armor plates installed on the floor of the passenger compartment 12 of the armored vehicle. Preferably, a single plate extends across substantially the entire floor area of the passenger compartment 12 and is rigidly attached to the frame 3 and the rear of the unibody 1. The armored floor resists or minimizes deformation in the passenger compartment 12 and assists in transferring blast loads from the driver compartment 2 to the entire vehicle frame 3.

Figure 9:
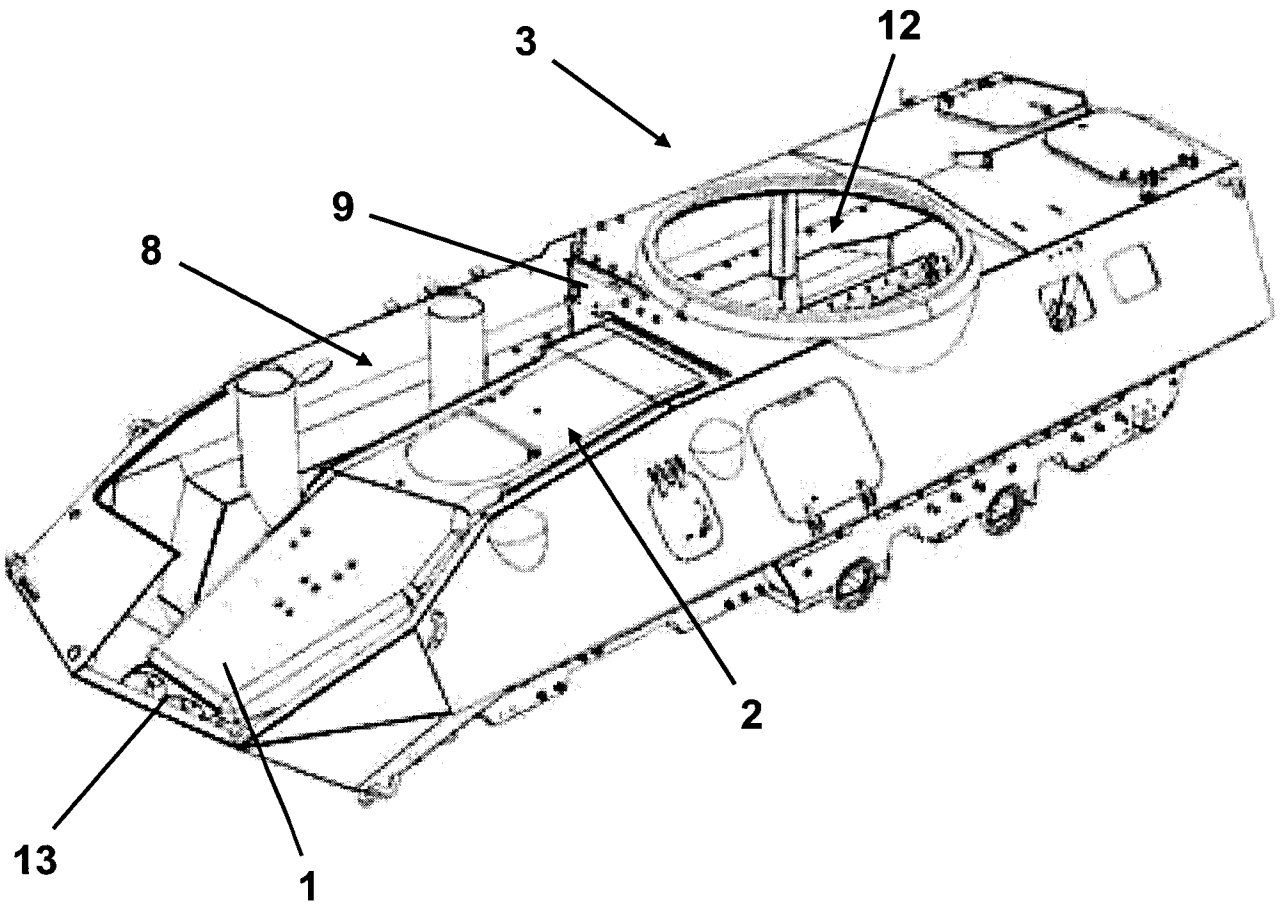
FIG. 9 is a perspective view of an armored vehicle with portions of the vehicle cut away showing the driver's compartment and the survivability capsule installed therein.

The retrofit method for installing a survivability capsule, according to the present invention, preferably comprises removing portions of the vehicle armor and frame 3 above the driver compartment 2 to expose the existing driver compartment 2 in order to install a unibody 1, as shown in FIG. 9. In the process, the installation may replace existing elements within the driver compartment 2, such as spall liners and any existing or localized structural reinforcements, such as armor plates or posts. After the installation of the capsule the removed portions are re-installed to close in the capsule. The survivability capsule is fitted within the driver compartment 2, preferably using spacers 13 to fill any gaps between the interior of the driver compartment 2 and the exterior of the unibody 1. The unibody 1 is rigidly attached to the existing vehicle frame 3 at a plurality of attachment locations, preferably by securing bolt fasteners through apertures 6 in the unibody 1. The removed portions of the vehicle frame 3 are then replaced to enclose the unibody 1 within the driver compartment 2 of the armored vehicle.

Existing vehicle frames may not have sufficient strength, stiffness, and structural integrity to enable distribution of the explosive loads, exerted on the unibody 1, to the rest of the vehicle. These vehicle frames may be reinforced to provide the required strength, stiffness, and structural integrity resist or minimize deformation and effectively transfer loads in the event of an explosive blast. Any known rigid supports may be used and attached to both the existing vehicle structure and the unibody 1 in order to distribute the loads from an explosive blast throughout the entire vehicle. Preferably, the frame 3 is reinforced with composite armor supports. The structure of the vehicle may be reinforced on both the outside and inside of the existing vehicle structure. Rigid supports are preferably attached to tapping pads welded to the existing vehicle structure.

One type of rigid support which may be used is armor reinforcements within the existing wheel wells of the armored vehicle. These armor reinforcements are rigidly attached to the vehicle frame 3 adjacent the wheel wells and to the unibody 1.

The forgoing description, together with the accompanying figures, have set out detail of the structure and function of the present invention, however, the disclosure is to be understood as illustrative of the preferred embodiments and changes may be made without departing from the scope of the invention herein described.

What is claimed is:

1. A survivability capsule for a driver of an armored vehicle, the armored vehicle having a frame and a driver compartment interior of the frame, wherein the driver compartment defines an open space within the frame and has a plurality of surfaces and an interior shape, the survivability capsule comprising:

a monolithic unibody consisting of molded composite armor having an exterior shape complementary to the interior shape of the driver compartment so as to form a contour fit therein abutting against the adjacent surfaces of the driver compartment and attachment locations on the unibody for rigidly attaching the unibody to the frame within the driver compartment.

2. The survivability capsule of claim 1, comprising an ingress and egress opening accessible from the interior of the vehicle.

3. The survivability capsule of claim 1, wherein the attachment locations comprise apertures through the unibody and wherein the unibody is rigidly attached to the frame by way of fasteners therethrough.

4. The survivability capsule of claim 1, wherein one or more spacers are used to fill one or more gaps between the unibody and frame.

5. The survivability capsule of claim 2, wherein the driver compartment is offset to one side of the armored vehicle and a wall structure consisting of moulded composite armor is rigidly attached at each end to the unibody and the frame.

6. The survivability capsule of claim 5, wherein the driver compartment is located adjacent an engine compartment and wherein the unibody further comprises a second ingress and egress opening on the side of the unibody adjacent the engine compartment and hatch closure therefor.

7. The survivability capsule of claim 1, wherein the composite armor is fiber reinforced resin.

8. The survivability capsule of claim 7, wherein the fiber reinforced resin comprises one or more fibers selected from the group consisting of E-glass, S-glass, aramid, and carbon.

* * * * *